US006332582B1

(12) United States Patent
Ikegami et al.

(10) Patent No.: US 6,332,582 B1
(45) **Date of Patent: *Dec. 25, 2001**

(54) SELF-PROPELLED CRUSHING MACHINE

(75) Inventors: Katsuhiro Ikegami; Masaho Yamaguchi, both of Kawasaki; Satoru Koyanagi, Tokyo, all of (JP)

(73) Assignee: Komatsu Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/344,244

(22) Filed: Jun. 25, 1999

(30) Foreign Application Priority Data

Jun. 26, 1998 (JP) ..... 10-196622
Jul. 9, 1998 (JP) ..... 10-211811

(51) Int. Cl.[7] ..... B02C 25/00
(52) U.S. Cl. ..... 241/36; 241/101.74
(58) Field of Search ..... 241/30, 34, 35, 241/36, 101.74, 101.761

(56) References Cited

U.S. PATENT DOCUMENTS 4,212,429 * 7/1980 Cuvelier et al. ..... 241/36
4,661,911 * 4/1987 Ellery ..... 241/36
5,215,263 * 6/1993 Getzmann ..... 241/36
5,580,004 12/1996 Tamura et al. .
5,803,376 * 9/1998 Koyanagi et al. ..... 241/36

* cited by examiner

*Primary Examiner*—Mark Rosenbaum
(74) *Attorney, Agent, or Firm*—Armstrong, Westerman, Hattori, McLeland & Naughton, LLP

(57) ABSTRACT

The present invention provides a self-propelled crushing machine in which a crushed material having a widely desired grain size can be obtained, a degree of freedom for automatically controlling a rotary tab and a rotary crusher can be preferably improved, and a crushing having a high efficiency can be performed. Accordingly, in a self-propelled crushing machine in which a rotary crusher (1) and a rotary tab (3) for introducing a material to be crushed thrown from an outer portion to the rotary crusher are provided on a self-propelled truck (4), and the material to be crushed is crushed by the rotary crusher and freely discharged to the outer portion, there are provided target crushing rotational speed setting means (5) for setting a target crushing rotational speed (Nhm) of the rotary crusher (1), actual crushing rotational speed detecting means (12) for detecting an actual crushing rotational speed (Nh) of the rotary crusher, crusher drive means (10) for setting the rotary crusher to be freely rotated, and control means (16) for inputting a target crushing rotational speed (Nhm) from the target crushing rotational speed setting means, inputting the actual crushing rotational speed (Nh) from the actual crushing rotational speed detecting means and outputting a crushing rotation control signal (Nhn) for maintaining a relation Nh−Nhm=0 to the crusher drive means by comparing them.

4 Claims, 6 Drawing Sheets

FLOW CHART FOR CONTROLLING ROTARY TUB

FLOW CHART FOR CONTROLLING ROTARY CRUSHER

SELF-PROPELLED CRUSHING MACHINE

FIELD OF THE INVENTION

The present invention relates to a self-propelled crushing machine for crushing thrown rocks, concrete, woods and the like and discharging to an outer portion.

BACKGROUND OF THE INVENTION

There exist various kinds of self-propelled crushing machines for crushing rocks, for crushing concrete, for crushing woods and the like. For example, the self-propelled crushing machine for crushing woods has, as shown in FIGS. 1 and 2, a rotary crusher 1 and a rotary tub 3 which introduces a wood 2 thrown from an outer portion to the rotary crusher 1 due to a rotation on a self-propelled truck 4, crushes the wood 2 introduced from a rotary tub 3 to the rotary crusher 1 and discharges to the outer portion. The details are as follows.

The rotary crusher 1 is a so-called hammer mill. This has a plurality of cutters 1*b* on an outer periphery of a shaft 1*a* which is structured to be made rotatable by crusher drive means, and crushes the wood 2 by the cutters 1*b*. The crusher drive means is driven by an oil hydraulic pressure, directly driven or the like.

The rotary tub 3 has a funnel 3*b* which is made rotatable by the tub drive means on a fixed bottom plate 3*a*. A part of the fixed bottom plate 3*a* is open, and the cutters 1*b* of the rotary crusher 1 can be overviewed from the opening. The tub drive means is also of an oil hydraulic driven type, a direct driven type or the like.

When throwing the wood 2 having a long size into the rotary tub 3, a lower end of the wood 2 is brought into contact with the upper portion of the fixed bottom plate 3*a* and the cutters 1*b* within the opening. On the contrary, the wood 2 falls down and an upper side surface thereof is brought into contact with an inner wall of the funnel 3*b*. A plurality of convex portions are provided on the inner wall of the funnel 3*b* in a vertical direction, and the convex portion presses the wood 2 due to a rotation of the funnel 3*b*. As a result, the lower end of the wood 2 reciprocates between the upper portion of the fixed bottom plate 3*a* and the cutter 1*b* while the wood 2 changes an attitude thereof, so that even the long wood 2 can be crushed by the cutters 1*b*. The crushed wood 2 is used for a pulp raw material, a manure, a fuel and the like.

In this case, the self-propelled crushing machine is structured such that when the raw materials are large or hard, or when they are mixed with the small raw materials or the soft raw materials, a load of the crusher is increased, a rotational speed is reduced, and a crushing efficiency is lowered. The reduction of the rotational speed causes a breakage of the crusher. Then, there is a structure made such as to automatically stop a raw material supply apparatus (the rotary tub 3 in the case of being used for crushing the wood) when the rotational speed of the crusher is lowered to a predetermined value Nb, and to automatically start the raw material supply apparatus when the rotational speed of the crusher is inversely increased to a predetermined value Na. In this case, in order to prevent the automatic stop and the automatic start from generating a hunting, a relation between the predetermined values Na and Nb is set to, for example, a relation Na>Nb+50 rpm.

However, the prior art mentioned above has the following problems.

(1) Since the raw material supply apparatus is automatically started or automatically stopped in accordance with a rotational change of the crusher, there is no function for automatically returning the crusher to a normal rotation although the reason of breaking the crusher is solved. Accordingly, a reduction of a crushing efficiency is unavoidable.

(2) A crushed grain size (a piece size in the case of the crusher for crushing the wood) becomes finer as the rotational speed of the crusher becomes higher. If the normal rotational speed of the crusher is set to Ns, a relation Ns>Na and Ns>Nb is established. In this case, since the relation Na>Nb is established as mentioned above, the changing range of the rotational speed of the crusher becomes wide to Ns to Nb. Accordingly, it is hard to obtain the crushed material having a fixed grain size.

(3) In particular, the self-propelled crushing machine for crushing the wood has the rotary tab, however, there has not been suggested a technique structured such as to preferably control the rotational speed and perform a crushing having a higher efficiency.

(4) The start and stop of the rotary tub depend only upon the rotational change of the crusher, and the rotary tub itself does not have an automatic control function. Further, the breakage of the crusher is indirectly prevented by the automatic start and the automatic stop of the rotary tub, and the crusher itself does not have an automatic control function.

(5) For example, when a long member made of a wood 2 and the like is held between the convex portion of the rotary tub 3 and the cutters 1*b*, a rotational force of the rotary tub 3 pushes the cutter via the wood 2. Accordingly, an excess load is generated in the rotary crusher 1, and the rotational speed is suddenly reduced. However, in the self-propelled crushing machine for crushing the wood 2, there is an operational effect that the rotary tub 3 is further rotated, so that the nipped wood 2 is taken out and the crushing is again started. In the case that the predetermined value Na is set so as to automatically stop the rotary tub 3, as in the prior art, this operational effect can not expected. On the contrary, when the thick and hard wood 2 is completely meshed with the cutters 1*b*, it is impossible to discharge the meshed wood 2 only by the automatic stop of the rotary tub 3 as in the prior art and it is necessary to discharge the wood 2 by human hands, so that the crushing efficiency is bad.

SUMMARY OF THE INVENTION

The present invention is made by taking the conventional problems mentioned above into consideration, and an object of the present invention is to provide a self-propelled crushing machine in which a crushed material having a widely desired grain size can be obtained, a degree of freedom for automatically controlling a rotary tub and a crusher can be preferably improved, and a crushing having a high efficiency can be performed.

In accordance with a first aspect of the present invention, there is provided a self-propelled crushing machine in which a rotary crusher and a rotary tub for introducing a material to be crushed thrown from an outer portion to the rotary crusher are provided on a self-propelled truck, and the material to be crushed which is introduced from the rotary tub is crushed by the rotary crusher and freely discharged to the outer portion, comprising target crushing rotational speed setting means for setting a target crushing rotational speed Nhm of the rotary crusher, actual crushing rotational speed detecting means for detecting an actual crushing rotational speed Nh of the rotary crusher, crusher drive means for setting the rotary crusher to be freely rotated, and control means for inputting a target crushing rotational speed Nhm from the target crushing rotational speed setting means, inputting the actual crushing rotational speed Nh from the actual crushing rotational speed detecting means and outputting a crushing rotation control signal Nhn for maintaining a relation Nh−Nhm=0 to the crusher drive means by comparing them.

In accordance with the first aspect, since the control means maintains the relation Nh−Nhm=0, it is possible to obtain a crushed material having a fixed grain size. Further, it is possible to freely set the target crushing rotational speed Nhm by the target crushing rotational speed setting means. Accordingly, it is possible to set an optimum target crushing rotational speed Nhm with respect to the materials to be crushed which are different in a hardness, a shape, a size and a batch, whereby the crushed material having a fixed grain size can be obtained. Further, it is possible to widely obtain the crushed material having a different grain size by variously changing the target crushing rotational speed Nhm with respect to the same material to be crushed.

In accordance with a second aspect, there is provided a self-propelled crushing machine as cited in the first aspect, further comprising tub drive means for making the rotary tub rotatable, and control means for inputting a target crushing rotational speed Nhm from the target crushing rotational speed setting means, inputting the actual crushing rotational speed Nh from the actual crushing rotational speed detecting means, outputting a crushing rotation control signal Nhn for maintaining a relation Nh−Nhm=0 to the crusher drive means by comparing them, and outputting a tub rotation control signal Ntn to the tub drive means.

In accordance with the second aspect, the tub drive means for setting the rotary tub rotatable is provided and the control means outputs the tub rotation control signal Ntn to the tub drive means. As mentioned above, since the control means can freely control the rotational speed of the rotary tub corresponding to a second reason for further efficiently performing a crushing operation, a crushing operation having a high efficiency can be performed.

In accordance with a third aspect, there is provided a self-propelled crushing machine as cited in the second aspect, further comprising control means for freely setting a rotational speed Nh0 having a relation Nh0<Nhm which is smaller than the target crushing rotational speed Nhm, and respectively outputting a tub rotation control signal Nt1 for normally rotating the rotary tub, a tub rotation control signal Nt2 for gradually reducing a positive rotational speed Nt in accordance with a reduction of the actual crushing rotational speed Nh, and a tub rotation control signal Nt3 for inversely rotating the rotary tub or stopping the rotary tab to the tub drive means when the actual crushing rotational speed Nh satisfies a relation Nh≧Nhm, a relation Nhm>Nh>Nh0, and a relation Nh≦Nh0.

In accordance with the third aspect, the following operational effects can be obtained.

The relation Nh≧Nhm corresponds to a state in which the actual crushing rotational speed Nh of the rotary crusher has a normal positive rotational speed. At this time, it is necessary that the rotary tub has a normal positive rotational speed, and this is compensated by the tub rotation control signal Nt1.

Further, the crushing rotational speed Nh0 of the rotary crusher has a relation Nh0<Nhm with respect to the target crushing rotational speed Nhm and can be freely set.

In this case, the relation Nhm>Nh>Nh0 corresponds to a state in which the actual crushing rotational speed Nh is lowered to a value immediately before the crushing rotational speed Nh0 expected to be a standard due to an increase of a load of the rotational crusher, so that it is desired to be quickly returned to the target crushing rotational speed Nhm. At this time, if the rotational speed of the rotary tub is a fixed rotation as in the prior art, the returning is delayed or the cutter is broken. However, in accordance with the third aspect, the control means 16 outputs the tub rotation control signal Nt2 for gradually reducing the positive rotational speed Nt of the rotary tub in correspondence to the actual crushing rotational speed Nh. Accordingly, the load of the rotation of the rotary crusher is reduced and it is easy to return to the target crushing rotational speed Nhm. That is, it is possible to widely obtain the crushed material having a desired grain size, and it is possible to increase a crushing efficiency.

The relation Nh≦Nh0 corresponds to a state in which the actual crushing rotational speed Nh becomes the rotational speed Nh0 expected to be a standard or equal to or less than the value. At this time, the control means 16 outputs the tub rotation control signal Nt3 for inversely rotating the rotary tub 3 or stopping the rotary tub 3. Accordingly, there is generated a chance that the meshing of the material to be crushed with the cutter 1*b* corresponding to a reason of reducing the actual crushing rotational speed Nh is automatically excluded. In this case, since the generation of the meshing (an increase of the load) mentioned above itself becomes rare due to the operational effect of the relation Nhm>Nh>Nh0, it is possible to further increase the crushing efficiency due to the operational effect of the relation Nh≦Nh0.

In accordance with a fourth aspect, there is provided a self-propelled crushing machine as cited in the third aspect, further comprising gradual reduction degree setting means for previously setting a degree f(L) of a gradual reduction of the rotational speed of the rotary tub.

In accordance with the fourth aspect, a further higher crushing efficiency can be achieved by setting the degree f(L) of the gradual reduction in correspondence to the state of the material to be crushed when gradually reducing the positive rotational speed Nt of the rotary tub. That is, the rotational speed of the rotary tub as well as the rotary crusher can be easily converged to the normal rotational speed by previously setting the degree f(L) of the gradual reduction at each of the hardness, the shape, the size, the amount and the like of the material to be crushed. The degree f(L) of the gradual reduction is given by, for example, tub gradual reduction functions f(La) to f(Lc) shown in FIGS. 5A to 5C.

In accordance with a fifth aspect, there is provided a self-propelled crushing machine comprising crusher load detecting means for detecting an actual rotational speed Nh of a rotary crusher for crushing a material to be crushed as a load, crusher overload judging means for inputting the actual rotational speed from the crusher load detecting means, comparing with a predetermined lower limit speed No and judging an overload of the rotary crusher, and positive and inverse rotating and stopping means for inputting an overload information from the crusher overload judging means and inversely rotating the rotary crusher.

In accordance with the fifth aspect, the crusher overload judging means inputs the actual rotational speed Nh from the crusher load detecting means so as to compare with the predetermined lower limit speed No, judges the overload of the rotary crusher, and outputs the overload information to the crusher inversely rotating means so as to inversely rotate the rotary crusher. The state that the load of the rotary crusher becomes excessive corresponds to the state that the material to be crushed are meshed therewith. However, since the rotary crusher is automatically rotated in an inverse direction due to the overload, the meshing of the material to be crushed can be automatically cancelled or the meshing can be easily removed by human hands. Accordingly, a crushing efficiency is increased. Further, since the rotary crusher itself controls its own state in accordance with the overload information, the degree of freedom for the control can be increased at that degree.

In accordance with a sixth aspect, there is provided a self-propelled crushing machine as cited in the fifth aspect, further comprising crusher overload judging means for judging an overload of the rotary crusher and judging that a number n2 of generating the overload becomes a predetermined number n20 within a predetermined time t20, and positive and inverse rotating and stopping means for stopping the rotary crusher when the overload generation number n2 from the crusher overload judging means becomes the predetermined number n20 within the predetermined time t20.

The crusher overload judging means in accordance with the sixth aspect is structured such as to further judge a time when the overload generation number n2 becomes the predetermined number n20 within the predetermined time t20 and stop the rotary crusher by the positive and inverse rotating and stopping means at that time. Accordingly, the rotary crusher automatically stops when an abnormal matter is generated. Accordingly, the rotary crusher is not broken and the crushing efficiency is further improved.

In accordance with a seventh aspect, there is provided a self-propelled crushing machine comprising tub load detecting means for detecting a load of a rotary tub for introducing a material to be crushed, tub overload judging means and positive and inverse rotating and stopping means for inversely rotating the rotary tub.

In accordance with the seventh aspect, the tub overload judging means can judge an overload of the tub on the basis of the information from the tub load detecting means, and can instruct an inverse rotation of the tub to the tub inverse rotating means. The overload of the rotary tub is caused by the case that the material to be crushed are meshed with the rotary crusher and the overload is indirectly involved in addition to the case that the rotary tub itself is under an overload. However, since the inverse rotation of the tub is automatically performed due to the overload, the meshing of the material to be crushed with the rotary crusher can be automatically cancelled, and the overload of the rotary tub itself can be cancelled. Accordingly, it is possible to stably rotate the rotary tub and the rotary crusher for a long time, and a crushing efficiency is significantly high. Further, since the rotary tub itself is controlled by the overload information of the rotary tub itself, the degree of freedom for the control is increased at that degree.

In accordance with an eighth aspect, there is provided a self-propelled crushing machine as cited in the seventh aspect, further comprising tub overload judging means for judging that an inverse rotation number n1 of the rotary tub by the positive and inverse rotating and stopping means becomes a predetermined inverse rotation number n10 within a predetermined time t10, and positive and inverse rotating and stopping means for inputting the overload information from the tub overload judging means and stopping the rotary tub.

The tub overload judging means in accordance with the eighth aspect is structured such as to further judge a time when the inverse rotation number n1 of the rotary tub by the tub inverse rotating means becomes the predetermined inverse rotation number n10 within the predetermined time t10, and output the overload information to the tub stopping means so as to stop the rotary tub. Accordingly, the rotary tub automatically stops when an abnormal matter is generated, so that the rotary tub and the rotary crusher is prevented from breaking, and a crushing efficiency is further increased.

In accordance with a ninth aspect, there is provided a self-propelled crushing machine comprising crusher load detecting means for detecting a load of a rotary crusher for crushing a material to be crushed, crusher overload judging means, tub load detecting means for detecting a load of a rotary tub for introducing the material to be crushed, tub overload judging means, and positive and inverse rotating and stopping means for positively and inversely rotating and stopping the rotary crusher and the rotary tub.

The ninth aspect is structured such as to substantially combine the fifth aspect and the seventh aspect. The ninth aspect is different from the fifth and seventh aspects in a point that the overload is obtained on the basis of the rotational speed Nh in the fifth and seventh aspects, however, the ninth aspect does not limit to the rotational speed Nh but a torque, an oil hydraulic pressure and the like can be replaced thereto. Therefore, in accordance with the ninth aspect, as well as the operational effects of the fifth and seventh aspects can be obtained, an applicable range thereof can be further expanded.

In accordance with a tenth aspect, there is provided a self-propelled crushing machine comprising crusher load detecting means for detecting an actual rotational speed Nh of a rotary crusher for crushing a material to be crushed as a load, crusher overload judging means for inputting the actual rotational speed Nh from the crusher load detecting means so as to compare with a predetermined lower limit speed No and judging an overload of the rotary crusher, tub load detecting means for detecting a load of a rotary tub for introducing the material to be crushed, tub overload detecting means for detecting an overload of the rotary tub, tub overload judging means for inputting a tub overload signal P1 from the tub overload detecting means so as to judge an overload of the rotary tub, and positive and inverse rotating and stopping means for inversely rotating the rotary tub when at least one of the crusher overload judging means and the tub overload judging means judges the overload.

In accordance with an eleventh aspect, there is provided a self-propelled crushing machine as cited in the tenth aspect, wherein the crusher overload judging means and the tub overload judging means add an inverse rotation number n1 obtained by inversely rotating the rotary tub, and stop the rotary tub by the positive and inverse rotating and stopping means when the number n1 reaches a predetermined inverse rotation number n10.

Since these tenth and eleventh aspects correspond to a combination of the structures of the fifth to ninth aspects mentioned above, the operational effects of the fifth to ninth aspects can be obtained in an overlapping manner, and since the structure is made such as to judge the overload of the rotary tub by inputting the tub overload signal also from the tub overload detecting means, it is possible to further select an accuracy of a control and a degree of freedom in correspondence to an object of crushing.

DETAILED DESCRIPTION OF THE PREFERRED EMBODIMENT

A first embodiment in accordance with the present invention will be described below with reference to FIGS. 1 to 5. In this case, an exemplified machine is a self-propelled crushing machine for crushing a wood which is explained in FIGS. 1 and 2, and a structure of an outer appearance is the same. Accordingly, different points therefrom will be mainly described in detail.

Figure 1:
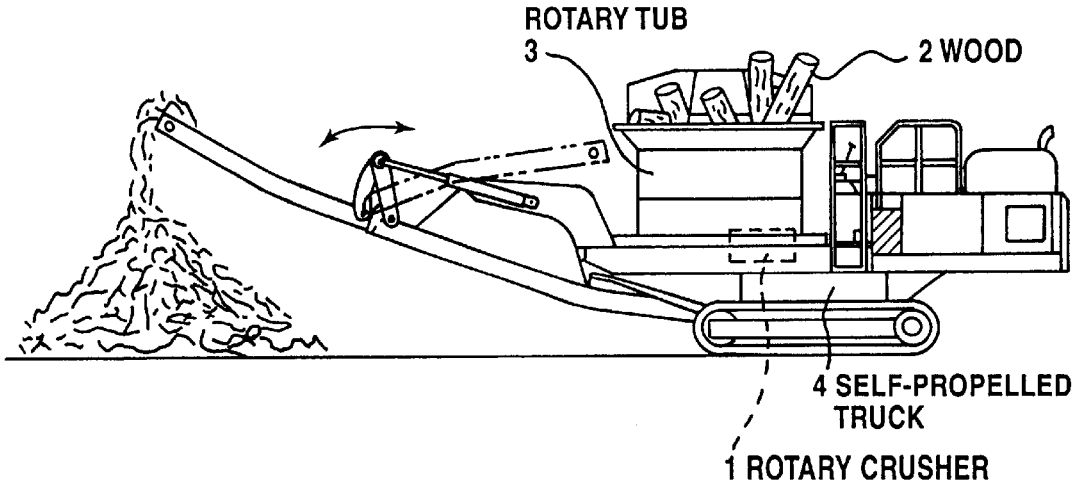
FIG. 1 is a side elevational view of a self-propelled crushing machine for crushing a wood.
Figure 2:
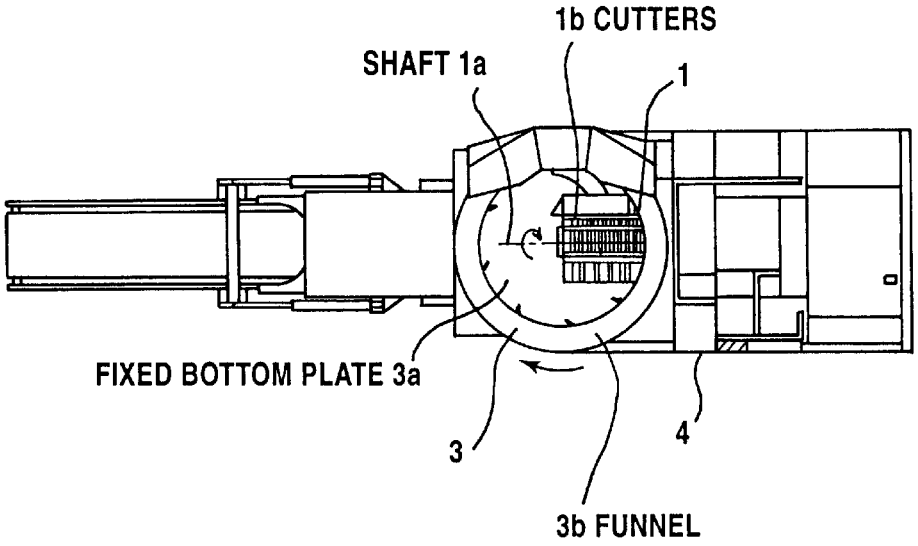
FIG. 2 is a plan view of FIG. 1.
Figure 3:
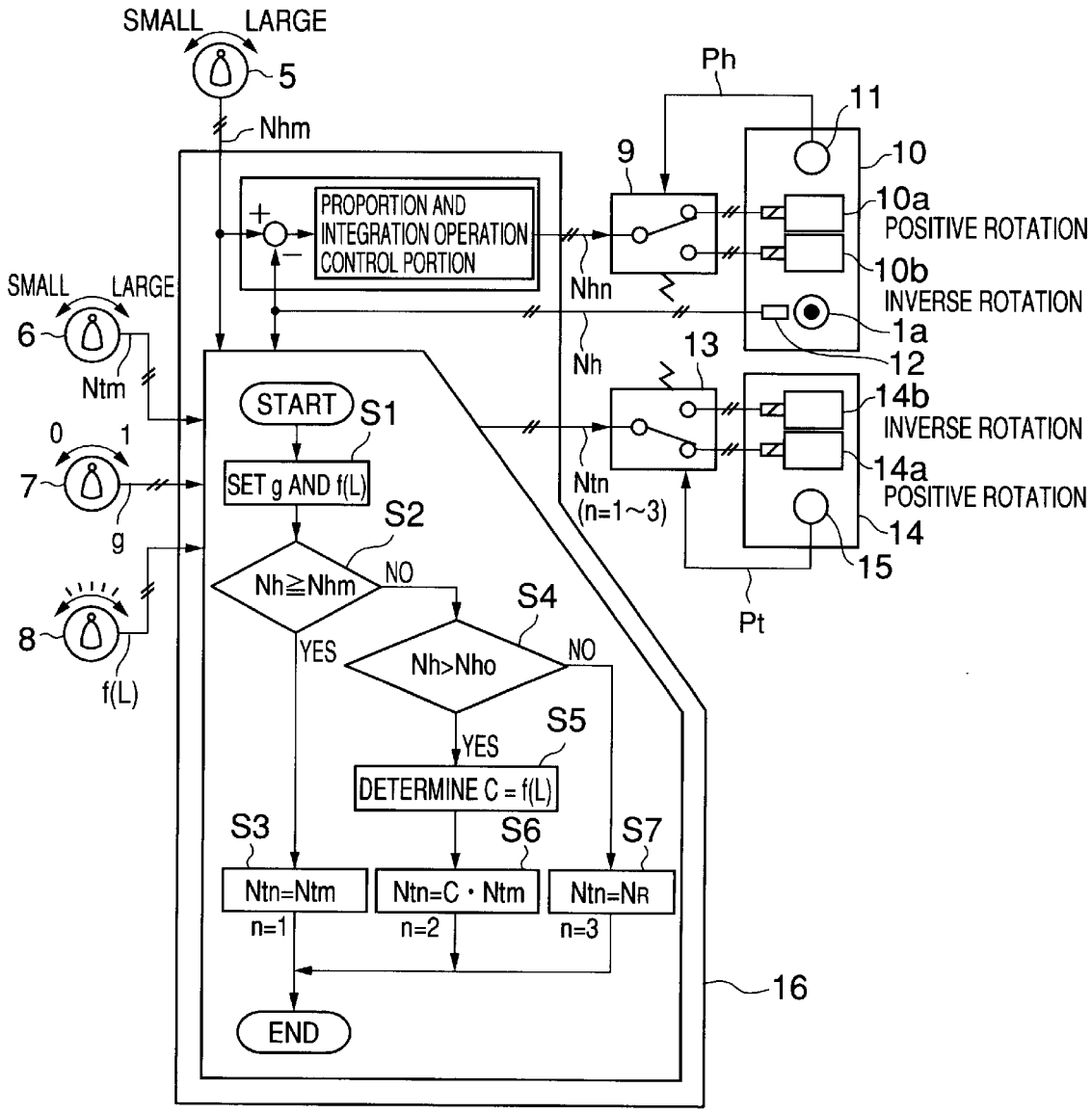
FIG. 3 is a control block diagram of a self-propelled crushing machine in accordance with a first embodiment of the present invention, which includes a control flow chart.

The exemplified machine has, as shown in FIG. 3, an operation control system and an alarm system comprising a target crushing rotational speed setting device 5, a target tab rotational speed setting device 6, a lower limit crushing rotational index setting device 7, a gradual reduction degree setting device 8, a crushing rotation positive and inverse switching device 9, crusher driving means 10, a crushing limit load detecting device 11, an actual crushing rotational speed detecting device 12, a tub positive and inverse direction switching device 13, tab driving means 14, a tab limit load detecting device 15, a control device 16, an alarm (not shown) and the like.

The target crushing rotational speed setting device 5 is a dial which an operator manually input a target crushing rotational speed Nhm in an alternative manner, and is provided in an operation panel (not shown). The target crushing rotational speed Nhm corresponds to a rotational speed of the rotary crusher 1 which is set so as to be optimum in each of a hardness, a shape and the like of a wood 2, for example, step values comprising 350 rpm, 400 rpm, 450 rpm, . . . , or an analogue value equal to or more than 350 rpm. The target crushing rotational speed Nhm is input to the control device 16.

The target tab rotational speed setting device 6 corresponds to a dial by which the operator manually inputs the target tub rotational speed Ntm in an alternative manner, and is provided in the operation panel. The target tub rotational speed Ntm corresponds to a rotational speed of the rotary tub 3 which is set to be optimum at each of the hardness, the shape and the like of the wood 2, and for example, is expressed by a step value such as 1 rpm, 1.5 rpm, 2 rpm, . . . , or an analogue value such as 1 rpm or more. The target tub rotational speed Ntm is input to the control device 16.

The lower limit crushing rotational index setting device 7 corresponds to a dial by which the operator manually inputs an index g in an alternative manner, and is provided in the operation panel. The index g is used for converting the target tub rotational speed Ntm into a tub rotation control signal Ntn which is optimum with respect to the hardness, the shape and the like of the wood 2 under being crushed. Further, it corresponds to a value for multiplying each of the target crushing rotational speed Nhm. Still further, a range of the index g is set to $0<g<1$, and for example, is expressed by a step value such as 0.5, 0.55, 0.6, 0.65, 0.7, 0.75, or an analogue value such as 0.5 to 0.75. The index g is input to the control device 16.

The gradual reduction degree setting device 8 corresponds to a dial by which the operator manually inputs a conversion value in an alternative manner, and is provided in the operation panel. The conversion value is used for obtaining the tub rotation control signal Ntn corresponding to a drive condition of the rotary crusher 1 obtained by the target crushing rotational speed Nhm, the actual crushing rotational speed Nh and the index g. That is, the conversion value corrects the target tub rotational speed Ntm so as to generate the tub rotation control signal Ntn. In this case, in the target tub rotational speed Ntm, in accordance with the relation $0<g<1$ mentioned above, the relation Ntm>Ntn is generated with respect to the tab rotation control signal Ntn. Accordingly, the conversion value becomes a value which shows a degree of a gradual reduction from Ntm to Ntn.

Figure 5A:
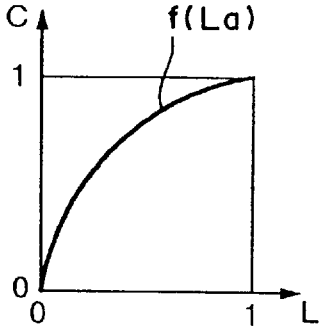
FIGS. 5A, 5B and 5C are graphs which respectively show tab gradual reduction functions (degrees of gradual reduction) f(La), f(Lb) and f(Lc) in the first embodiment.
Figure 5B:
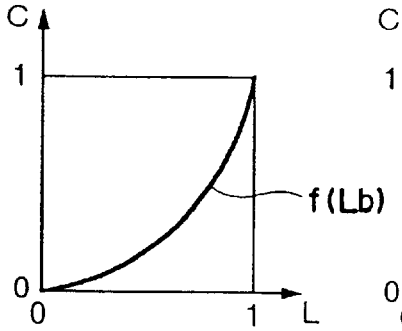
Figure 5C:
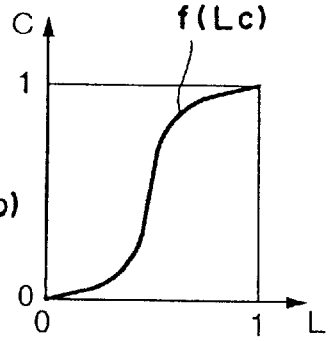

The degree of the gradual reduction is provided as a plurality of functions f(La) to f(Lc) as exemplified in FIGS. 5A to 5C, and can be alternatively selected by the gradual reduction degree setting device 8. In this case, the degree of the gradual reduction is not limited to the function f(L), and may be based on, for example, a method of extracting from various kinds of gradual reduction degrees previously set in a matrix manner. The function f(L) and the various kinds of gradual reduction degrees are input to the control device 16. The gradual reduction degree setting device 8 inputs a signal for alternatively selecting the various kinds of gradual reduction degrees previously input to the control device 16, to the control device 16.

The crushing rotation positive and inverse switching device 9 is provided between the control device 16 and the crusher driving means 10, and freely rotate the rotary crusher in positive and inverse directions.

The crusher driving means 10, which is not illustrated, is hydraulically driven in the exemplified machine. Accordingly, it has an oil tank, an oil hydraulic pump, an oil hydraulic motor for rotating the shaft 1*a* of the rotary crusher 1, a direction switching vale provided between the oil hydraulic pump and the motor, a relief valve and the like. The direction switching valve has three positions comprising a positive rotation position, a neutral position (a stop position) and an inverse rotation position, and is provided with a positive rotation side proportional solenoid 10*a* and an inverse rotation side proportional solenoid 10*b* in the side of the positive rotation position and in the side of the inverse rotation position, respectively. The direction switching valve becomes at the neutral position when the crushing rotation control signal Nhn is not outputted to both of the solenoids 10*a* and 10*b*.

The crushing limit load detecting device 11 corresponds to a pressure switch provided in an oil passage between the oil hydraulic motor of the crusher driving means 10 and the positive rotation position of the direction switching valve.

The actual crushing rotational speed detecting device 12 is a so-called rotation sensor, is provided in such a manner as to be close to and to oppose to the shaft 1*a* of the rotary crusher 1 in the exemplified machine, and detects the actual rotational speed Nh (the actual crushing rotational speed Nh) of the shaft 1*a* so as to input to the control device 16.

The tub positive and inverse direction switching device 13 is provided between the control device 16 and the tub driving means 14, and freely rotates the rotary tub 3 in positive and inverse directions.

The tub driving means 14 is hydraulically driven, and has an oil tank (not shown), an oil hydraulic pump, an oil hydraulic motor for rotating the rotary tab 3, a direction switching vale provided between the oil hydraulic pump and the motor and a relief valve and the like. The direction switching valve has three positions comprising a positive rotation position, a neutral position (a stop position) and an inverse rotation position, and is provided with a positive rotation side proportional solenoid 14*a* and an inverse rotation side proportional solenoid 14*b* in the side of the positive rotation position and in the side of the inverse rotation position, respectively. The direction switching valve becomes at the neutral position when the tub rotation control signal Ntn is not outputted to both of the solenoids 14*a* and 14*b*.

The tub limit load detecting device 15 corresponds to a pressure switch provided between the oil hydraulic motor of the tub driving means 14 and the positive rotation position of the direction switching valve.

The control device 16 inputs the target crushing rotational speed Nhm from the target crushing rotational speed setting device 5, the target tub rotational speed Ntm from the target tub rotational speed setting device 6, the index g from the lower limit crushing rotation index setting device 7 and the actual crushing rotational speed Nh from the actual crushing rotational speed detecting device 12, respectively, calculates them, and outputs the crushing rotation control signal Nhn to the crushing rotation positive and inverse direction switching device 9, the tub rotation control signal Ntn to the tub positive and inverse direction switching device 13 and a predetermined signal to the alarm, respectively. In this case, each of the control signals Nhm and Ntn is a solenoid driving current.

The alarm (not shown) is constituted by, for example, an alarm, an alarming light, an optodevice such as a CRT, a liquid crystal screen and the like, and informs the operator and the like of states of various kinds of operations and a detected information.

Next, an example of an operation of the control device 16 will be described below with reference to FIGS. 3 to 5C.

(1) The operator determines the target crushing rotational speed Nhm and the target tub rotational speed Ntm at each of the hardness, the shape and the like of the wood 2. It is desired that the determination is performed in accordance with a description "a target crushing rotational speed Nhm and a target tub rotational speed Ntm preferable for each of a hardness, a shape and the like of a wood 2" described in an explanation plate attached near the operation plate or an operation manual of the exemplified machine.

For example, when a crushing is performed for using a useless material wood after growing a mushroom and the like as a manure, it is preferable to set both of the target rotational speeds Nhm and Ntm to a high speed since the material wood is brittle. Since a building wasted material (a pine material or a lauan material) withering for a long time is soft, it is preferable to set both of the target rotational speeds Nhm and Ntm to a middle speed close to a high speed. Further, in the case of a thick wood in which an inner portion is hard to be caused an aged deterioration, a crosstie in a railroad line which is impregnated with oils and fats, a live wood having a strong fibrous tissue and a high viscosity, it is preferable to set both of the target rotational speeds Nhm and Ntm to a middle speed. In this case, in a hard oak material and the like, it is preferable to set both of the target rotational speeds Nhm and Ntm to a middle speed close to a low speed. Further, the raw material is not limited to the wood 2, and for example, in a hard resin such as an engineering plastic, it is preferable to set both of the target rotational speed Nhm and Ntm.

The above description is a general consideration in view of an operation amount. On the contrary, when it is desired to make the crushed size small, the target crushing rotational speed Nhm is made fast, and when it is desired to make the crushed size great, the target crushing rotational speed Nhm is made slow. Further, when it is desired to increase the crushed amount, the target tub rotational speed Ntm is made fast. It is because the faster the target tub rotational speed is made, the more the amount of the wood 2 being brought into contact with the cutter 1*b* is increased. That is, a degree of freedom for controlling both of the target rotational speed Nhm and Ntm in a single manner or a combination manner can be obtained at each of the hardness, the shape and the like of the wood 2. Setting and inputting of both of the target rotational speed Nhm and Ntm are performed by the target crushing rotational speed setting device 5 and the target tab rotational speed setting device 6, respectively.

(2) The operator inputs the target crushing rotational speed Nhm and the target tub rotational speed Ntm by a dial in accordance with the hardness, the shape and the like of the wood 2 as well as starting the exemplified machine. Next, the operator inputs the index g by the lower limit crushing rotation index setting device 7 and inputs the degree of the gradual reduction f(L) by a dial by the gradual reduction degree setting device 8. It is preferable that the index g is set to a great value as the wood 2 is softer or narrower, for example, 0.75 is preferable. On the contrary, when the wood 2 is hard or thick, it is set to a small value, for example, 0.5.

The degree of the gradual reduction f(L) is preferably set to f(La) shown in FIG. 5A when the wood 2 is soft or narrow. On the contrary, when the wood 2 is hard or thick, f(Lb) shown in FIG. 5B is preferable. Further, when the wood 2 is constituted by mixing the soft, hard, narrow and thick materials, it is preferable to employ f(Lc) shown in FIG. 5C. Further, it is preferable to employ a hysteresis-like matter by overlapping f(La) and f(Lb). In any case, various kinds of degrees of the gradual reduction f(L) should be prepared.

It is desired that the target crushing rotational speed Nhm, the target tub rotational speed Ntm, the index g and the degree of the gradual reduction f(L) are structured such that the operator suitably renews in correspondence to the operation state of the exemplified machine when the exemplified machine is operated.

In this case, when the index g is, for example, only 0.7 and the degree of the gradual reduction f(L) is, for example, only f(La), it is sufficient that the control device 16 previously stores them. In this case, the lower limit crushing rotational index setting device 7 and the gradual reduction degree setting device 8 are not required.

(3) When inputting the target crushing rotational speed Nhm, the control device 16 outputs a driving current to the positive rotation side proportional solenoid 10*a* of the crusher driving means 10 via the crushing rotation positive and inverse direction switching device 9 so as to positively rotate the rotary crusher 1. The actual crushing rotational speed Nh of the rotary crusher 1 is detected by the actual crushing rotational speed detecting device 12 and fed back to the control device 16. In the exemplified machine, the crushing rotation control signal Nhn for maintaining the relation Nh−Nhm=0 in accordance with a proportional integral operation control is input to the positive rotation side proportional solenoid 10*a* via the crushing rotation positive and inverse direction switching device 9. On the contrary, the control device 16 receives the target tub rotational speed Ntm and applies a driving current to the positive rotation side proportional solenoid 14*a* of the tub driving means 14 so as to positively rotate the rotary tub 3. In this case, when the wood 2 is meshed with the cutter 1*b*, whereby a high pressure is generated in the oil hydraulic motor and the pressure switch 11 corresponding to the crushing limit load detecting device is operated, the detecting signal acts on the crushing rotation positive and inverse switching device 9 so as to inversely rotate the rotary crusher 1. In the exemplified machine, the time for the inverse rotation is set to some seconds, and the positive rotation is again performed after some seconds. However, in the case that the positive and inverse rotation is generated at a plurality of times within a certain setting time, for example five times, the crushing rotation control signal Nhn is set to 0 so as to stop the rotary crusher 1. Since the meshing of the wood 2 is taken out from the cutter 1*b* due to the positive and inverse rotation, the rotary tub 3 and the rotary crusher 1 are not broken. The operator can easily remove the wood 2 taken out from the cutter 1*b*.

In this case, the actual crushing rotational speed Nh of the rotary crusher 1 is changed on the basis of the load change in accordance with the hardness, the shape and the amount of the wood 2. On the contrary, the structure for maintaining the actual crushing rotational speed Nh to the target crushing rotational speed Nhm is the proportional integral operation control mentioned above. On the contrary, the hardness, the shape and the amount of the wood 2 affects the rotation of the rotary tub 3. That is, both of the rotary crusher 1 and the rotary tub 3 change the rotational speed in accordance with the change of the load, however, they compensate for each other and affect well and badly. Then, the control device 16 corrects, as shown in a flow chart in FIG. 3, the target tub rotational speed Ntm of the rotary tub 3 in accordance with the target crushing rotational speed Nhm of the rotary crusher 1, the actual crushing rotational speed Nh, the index g and the gradual reduction degree f(L) so as to set the tub rotation control signal Ntn, and outputs the tub rotation control signal Ntn to the tub driving means 14 via the tub positive and inverse direction switching device 13. The details are as follows.

In a step S1, when inputting the target crushing rotational speed Nhm, the actual crushing rotational speed Nh, the index g (for example, g=0.6) and the gradual reduction degree f(L) (for example, f(La)), the control device 16 stores the index g=0.6 and the gradual reduction degree f(La) until renewing after inputting a new index g (for example, g=0.65) and a new gradual reduction degree f(L) (for example, f(Lb)).

When a relation among the target crushing rotational speed Nhm, the actual crushing rotational speed Nh, and the index g is Nhm>Nh>g·Nhm, it calculates a formula (Nh−g·Nhm)/(Nhm−g·Nhm) by using the index g. The result is equivalent to L2/L1 shown in FIG. 4, and when this is substituted for L, the following formula can be obtained.

$$L=L2/L1=(Nh-g\cdot Nhm)/(Nhm-g\cdot Nhm)$$

Figure 4:
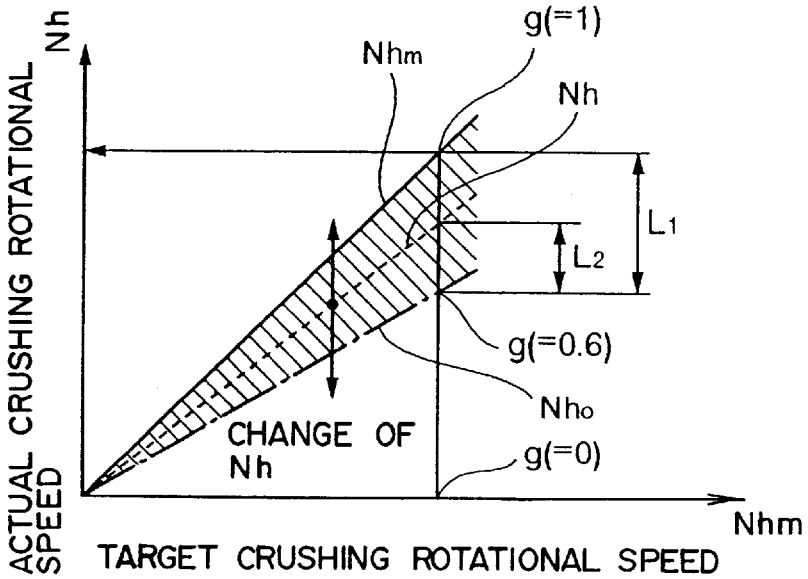
FIG. 4 is a graph which shows a relation between a target crushing rotational speed, an actual crushing rotational speed and an index in the first embodiment.

Here, as is apparent from the above formula and FIG. 4, L satisfies the relation 0≦L≦1, and corresponds to a variable which changes in correspondence to a change of the actual crushing rotational speed Nh. This L is substituted for the variable L in the gradual reduction degree f(L).

Further, in accordance with FIG. 4, $$L=L2/L1=(Nh-Nh0)/(Nhm-Nh0)$$

and a relation Nh0=g·Nhm is established.

Accordingly, a description will be given below by using L and Nh0 in place of the index g.

In a step S2, the control device 16 compares the target crushing rotational speed Nhm with the actual crushing rotational speed Nh.

When the result of comparison in the step S2 satisfies the relation Nh≧Nhm, the step goes to a step S3, and the control device 16 calculates the tub rotation control signal Ntn on the basis of the formula Ntn=Ntm, n=1 (hereinafter, refer to as a signal Nt1), and inputs to the positive rotation side proportional solenoid 14*a* via the tub positive and inverse direction switching device 13. Accordingly, the rotary tub 3 positively rotates at the target tub rotational speed Ntm.

On the contrary, when the result of comparison in the step S2 satisfies the relation Nh<Nhm, the step goes to a step S4, and the control device 16 compares the relation Nh>Nh0.

The result of comparison in the step S4 satisfies the relation Nh>Nh0, the step goes to a step S5, and the control device 16 substitutes the variable L (=L2/L1) for the gradual reduction degree f(L) so as to determine a tub gradual reduction function C=f(L).

For example, in the function f(La) in FIG. 5A, the actual tub rotational speed of the rotary tub 3 is going to converge into the target tub rotational speed Ntm without relation to a value of L. This is preferable to be applied to the soft or narrow wood 2 which can be easily crushed even when the wood 2 is meshed with the cutter 1*b*. On the contrary, with respect to the hard or thick wood 2 which suddenly stops the cutter 1*b* when the wood 2 is meshed with the cutter 1*b*, it is desirable to converge the rotational speed of the rotary tub 3 into a direction of suddenly reduce the rotational speed. In this case, the function f(Lc) in FIG. 5C will be employed. As mentioned above, the tub gradual reduction function C=f(L) should be suitably determined in accordance with the kind of the various materials, the crushed size, the shape, the amount, the mixed state or the like.

In a step S6, the control device 16 calculates the tub rotation control signal Ntn in accordance with the formula Ntn=C·Ntm, n=2 (hereinafter, refer to as Nt2), and outputs to the positive rotation side proportional solenoid 14*a* via the tub positive and inverse direction switching device 13. Accordingly, the rotary tub 3 is gradually reduced or increased in proportional to the tub gradual reduction function C=f(L).

On the contrary, when the result of the comparison in the step S4 satisfies the relation Nh≦Nh0, the step goes to a step S7, and the control device 16 calculates the tub rotation control signal Ntn for inversely rotating the rotary tub 3 in accordance with the formula Ntn=NR, n=3 (hereinafter, refer to as a signal Nt3) and outputs to the inverse rotation side proportional solenoid 14*b* via the tub positive and inverse direction switching device 13. Accordingly, the rotary tub 3 inversely rotates in accordance with the inverse rotational speed NR.

In this case, a magnitude of the signal Nt3, that is, the inverse rotational speed NR of the rotary tub 3 can be freely set, however, in the exemplified machine, it is set to the same as the target tub rotational speed Ntm. Since the wood 2 meshed with the cutter 1*b* is taken out due to the inverse rotation, the actual crushing rotational speed Nh of the rotary crusher 1 is increased and the rotary tub 3 is early returned to the positive rotation.

In accordance with the first embodiment, it is possible to obtain a crushed material having a widely desired grain size and increase an efficiency of crushing.

For example, when the hard wood is meshed between a plurality of convex portions provided on an inner wall of the funnel 3*b* in a vertical direction and the cutter 1*b* in a bridging manner, an overload is generated in the rotary tub 3 and a high pressure is generated in the oil hydraulic motor. When this reaches a relief pressure, the rotary tub 3 naturally stops. However, the pressure switch 15 corresponding to the tub limit load detecting device is operated at a stage having a pressure lower than the relief pressure, and the detecting signal Pt acts on the tub positive and inverse direction switching device 13 so as to inversely rotate the rotary tub 3. Accordingly, the rotary tub 3 and the rotary crusher 1 are not broken.

Hereinafter, an application of the first embodiment will be briefly described below.

(1) In the present embodiment, the rotary tub 3 is inversely rotated or stopped when the pressure switch 15 corresponding to the tub limit load detecting device is operated, however, it is possible to inversely rotate or stop the rotary tub 3 when the result of the comparison in the step S4 satisfies the relation Nh≦Nh0. In accordance with this structure, since no new wood is thrown into the cutter 1*b,* the actual crushing rotational speed Nh of the rotary crusher 1 is increased, and the state is automatically returned so as to satisfy the relation Nh≧Nhm or Nhm>Nh0 in accordance with the increase. In this case, the pressure switch 15 is not required.

(2) In the present embodiment, the index g is input, however, since the relation Nh0=g·Nhm is established as mentioned above, it is possible to directly input the rotational speed Nh0 in place of the index g (upon Nho<Nhm).

(3) In the present embodiment, the crushing rotation positive and inverse direction switching device 9 and the tub positive and inverse direction switching device 13 are provided in such a manner as to be independent from the control device 16, however, they can be included within the control device 16.

Figure 7:
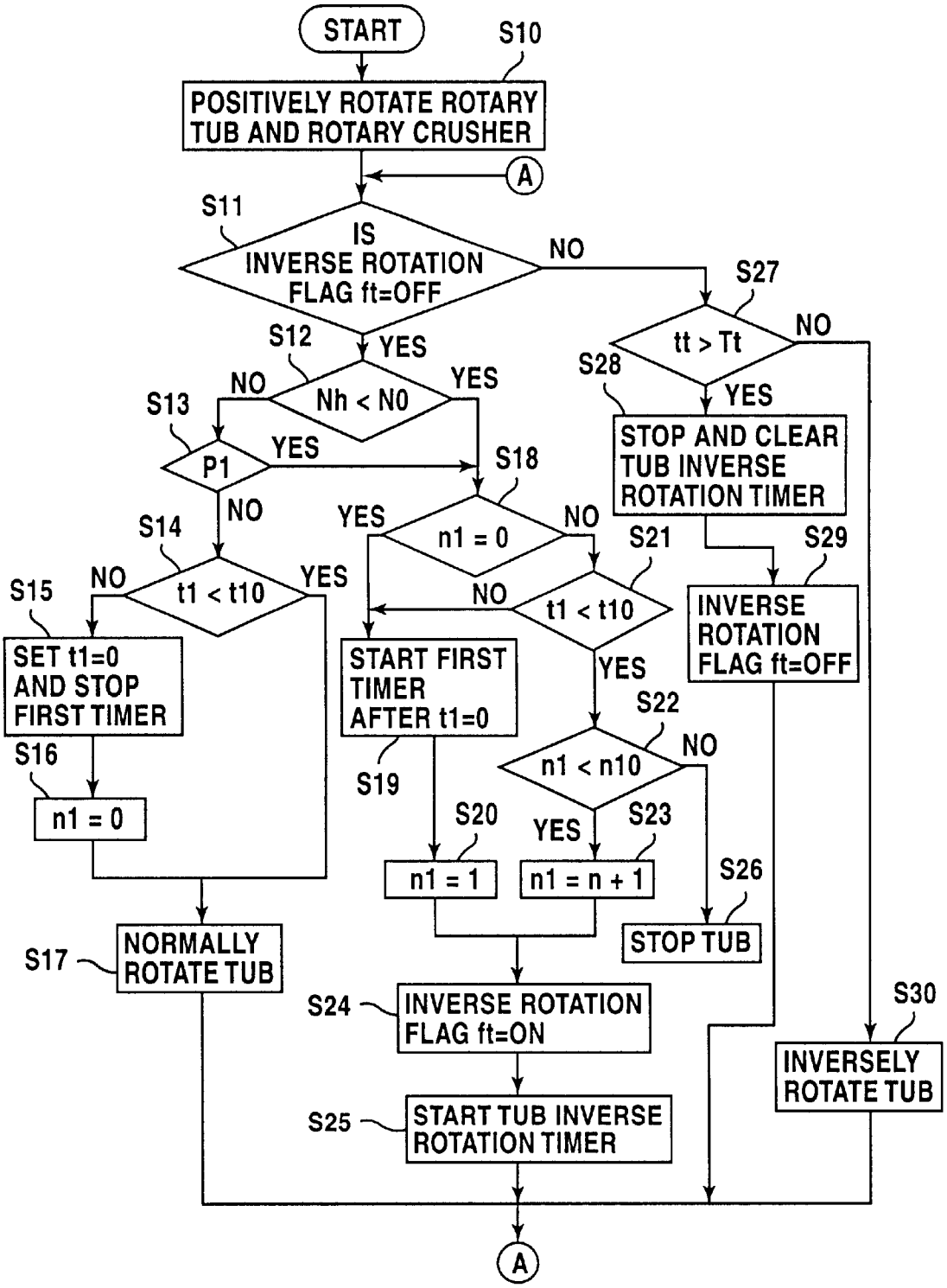
FIG. 7 is a flow chart for controlling a rotary tub in accordance with the second embodiment.
Figure 8:
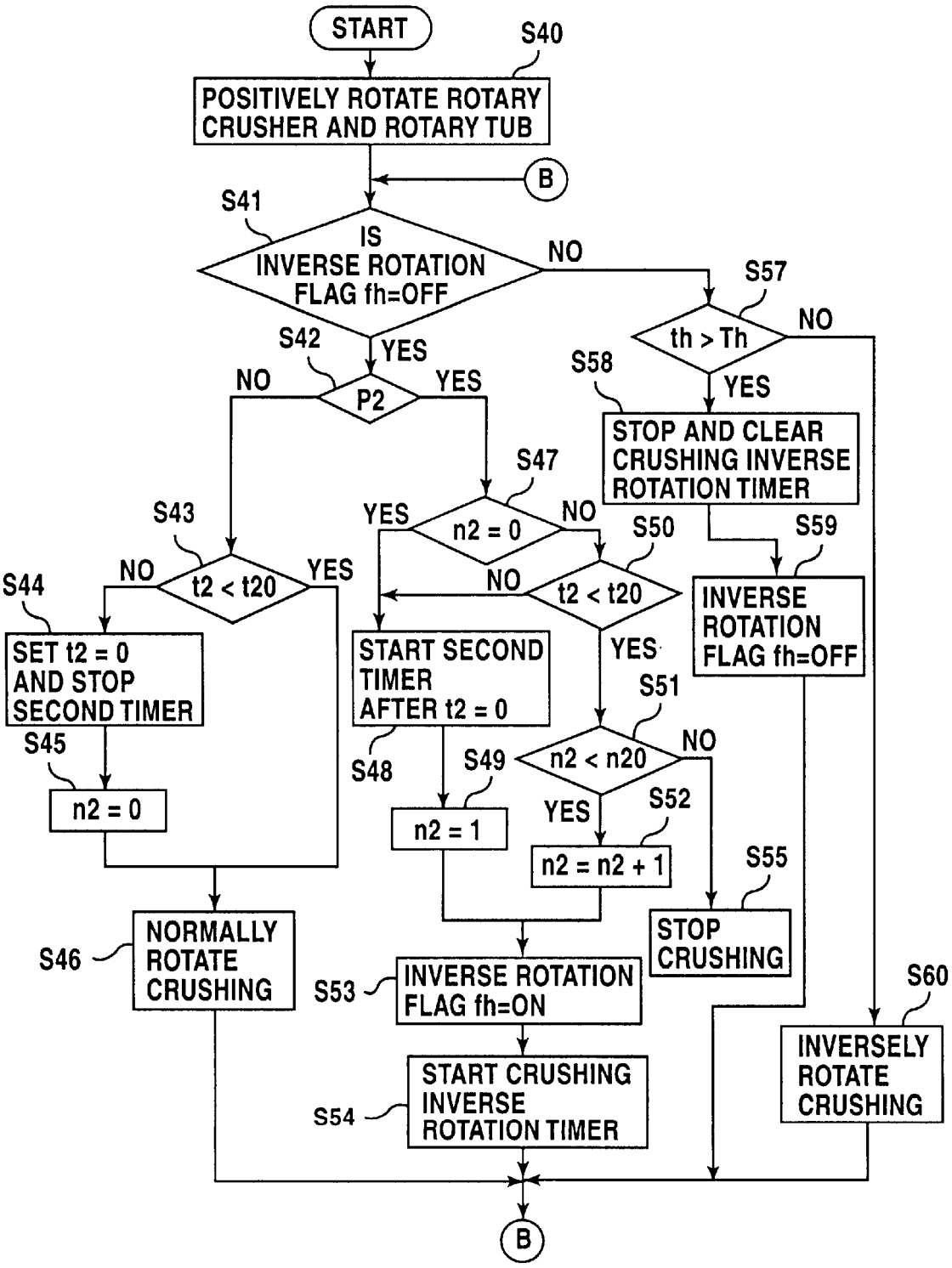
FIG. 8 is a flow chart for controlling a rotary crusher in accordance with the second embodiment.

Next, a second embodiment in accordance with the present invention will be described below with reference to FIGS. 6 to 8. The exemplified machine is the self-propelled crushing machine for crushing the wood described in FIGS. 1 and 2, and for example, a hammer mill is employed as the rotary crusher 1.

Figure 6:
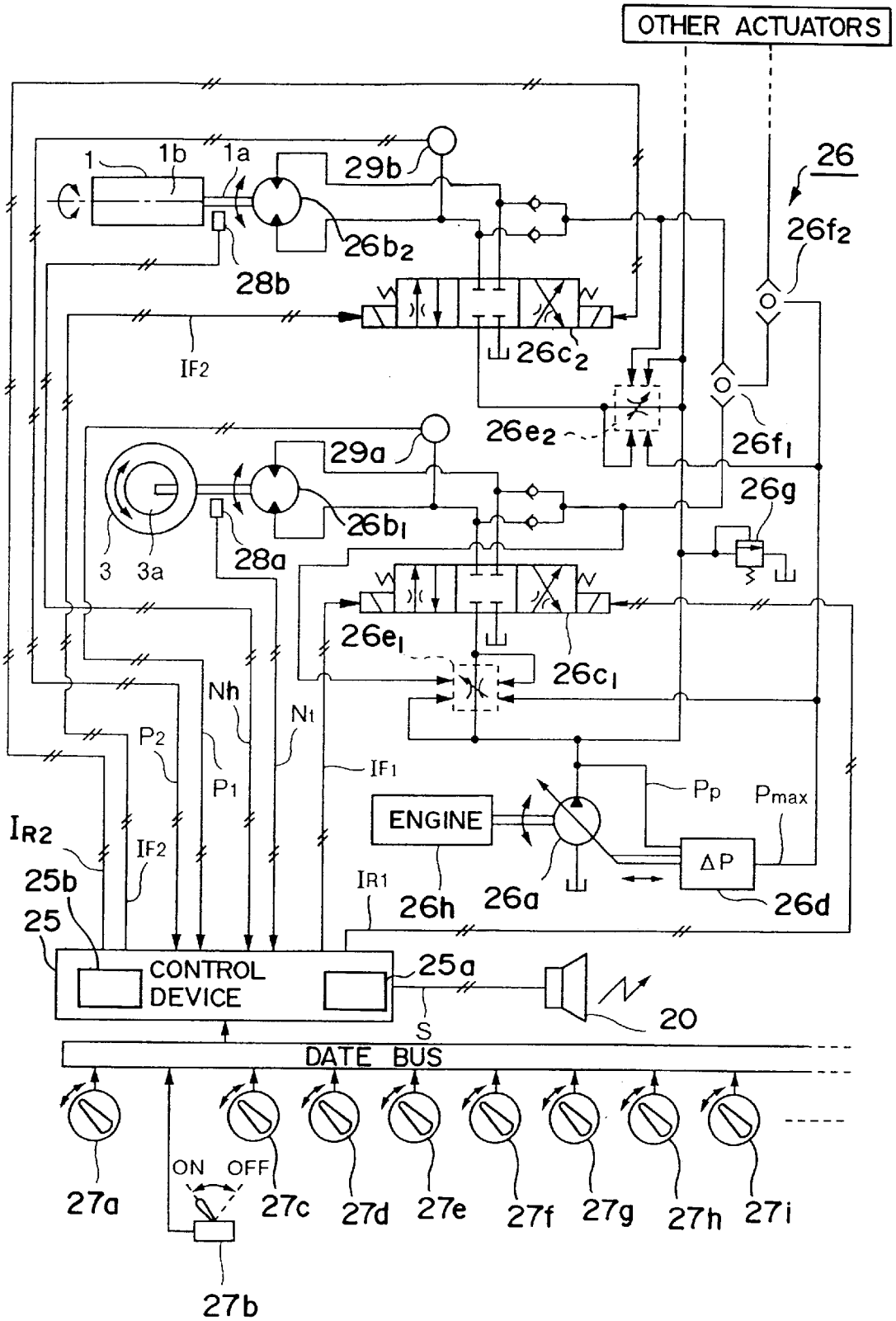
FIG. 6 is a control block diagram of a self-propelled crushing machine in accordance with a second embodiment of the present invention.

The exemplified machine is provided with a control device 25 installing crusher overload judging means 25*b* and tub overload judging means 25*a,* and an oil hydraulic circuit 26 controlled in accordance with an electric signal from the control device 25, as shown in FIG. 6. Further, it has a dial 27*a,* a switch 27*b,* dials 27*c* to 27*i,* a tub rotational speed detecting device 28*a,* a crushing rotational speed detecting device 28*b,* a tub overload detecting device 29*a,* a crusher overload detecting device 29*b,* an alarm 20 and the like.

The control device 25 is constituted by a controller using a micro computer, and is structured such as to previously store an operation programs for each of controls mentioned below, be input an information signal from each of the dial 27*a,* the switch 27*b,* the dials 27*c* to 27*i,* the tub rotational speed detecting device 28*a,* the crushing rotational speed detecting device 28*b,* the tub overload detecting device 29*a,* the crusher overload detecting device 29*b* and the like, operate them on the basis of the operation programs and output a control signal as a result thereof to the alarm 20, the oil hydraulic circuit 26 and the like.

The oil hydraulic circuit 26 has the rotary crusher 1, the rotary tub 3 and respective oil hydraulic actuators for driving a belt conveyor and the like (which are omitted to be illustrated), and in particular serves as positive and inverse rotating and stopping means 26 for positively and inversely rotating and stopping the rotary crusher 1 and the rotary tub 3. In this case, the normal self-propelled crushing machine has an oil hydraulic pump for each of the oil hydraulic actuators, however, in the exemplified machine, a closed-center load sensing system (hereinafter, refer to as a CLSS) is employed for the oil hydraulic circuit 26. Hereinafter, the CLSS will be described below.

The CLSS is constituted by one variable volume type oil hydraulic pump, a closed-center switching valve for supplying and discharging a discharged oil from the oil hydraulic pump with respect to the oil hydraulic actuator and a servo valve which receives a differential pressure Δp (a load sensing pressure Δp) between a front and a rear of the switching valve and changes a discharge amount of the oil hydraulic pump so that the front and rear differential pressure Δp becomes a fixed value. In this case, in the CLSS, a plurality of variable volume type oil hydraulic pumps may be provided, however, in this case, the discharged oils from the respective oil hydraulic pumps are combined and the switching valve and the oil hydraulic actuator are subsequently arranged in the downstream side thereof.

Well, a flow amount Qp flowing through a throttle of the switching valve or the like can be generally expressed by the following formula.

$$Qp\ Z(\Delta p)^{1/2}$$

In this formula, Z is an area of an opening of the switching valve. Further, since the CLSS has the servo valve for changing the discharge amount of the oil hydraulic pump so that the front and rear differential pressure Δp of the switching valve becomes a fixed value, the above formula can be expressed by the following formula.

$$Qp\ Z$$

In this formula, since the area Z of the opening of the switching valve is proportional to a stroke thereof, a flow amount in proportion to the stroke of the switching valve flows through the switching valve without relation to the load pressure of the oil hydraulic actuator. The flow amount corresponds to the discharge amount Qp of the oil hydraulic pump. Particularly speaking, when stroking the switching valve to a certain position, an operation speed of the oil hydraulic actuator is going to become a velocity proportional to the stroke without relation to the load to the oil hydraulic actuator. That is, the oil hydraulic pump does not discharge a flow amount equal to or more than a necessary amount, so that an energy can be saved. In this case, when a plurality of oil hydraulic actuators are provided and a composite operation is performed, a pressure compensating valve is provided in any one of a front side of each of the switching valves, a rear side of each of the switching valves, an IN side of each of the oil hydraulic actuators and an OUT side of each of the oil hydraulic actuators. Each of the pressure compensating valves receives a maximum load pressure Pmax in each of the oil hydraulic actuators through a shuttle valve as a pilot pressure at a composite operation, and generates a pressure loss obtained by the following formula between the oil hydraulic actuator under a light load and the oil hydraulic pump.

Maximum load pressure *P*max+Front and rear differential pressure Δ*p*=Light load pressure+Front and rear differential pressure of switching valve Δ*p*+Pressure loss in pressure compensating valve=Pump discharge pressure *Pp*

In this case, the pressure compensating valve in which the maximum load pressure Pmax is generated does not generate a pressure loss. As a result, even when the load of each of the oil hydraulic actuators is different from each other, each of the oil hydraulic actuators flows a flow amount in proportion to the stroke of each of the switching valves. The discharge amount of the oil hydraulic pump at the composite operation corresponds to a total of the flow amount which passes through each of the switching valves.

The exemplified machine has an oil hydraulic actuator in each of the rotary crusher 1 and the rotary tab 3. Respective elements in the CLSS of the oil hydraulic circuit 26 are constituted by one variable volume type oil hydraulic pump 26*a,* a tub oil hydraulic motor 26*c*1 a crusher oil hydraulic motor 26*b*2 corresponding to an oil hydraulic actuator, a tub switching valve 26*c*1 and a crusher switching valve 26*c*2 corresponding to a switching valve, a servo valve 26*d,* pressure compensating valves 26*e*1 and 26*e*2, and shuttle valves 26*f*1 and 26*f*2. The pressure compensating valves 26*e*1 and 26*e*2 are arranged in a front side of each of the switching valves 26*c*1 and 26*c*2 (an IN side of each of the oil hydraulic actuators 26*b*1 and 26*b*2). In this case, the pressure compensating valves 26*e*1 and 26*e*2 may be arranged in a rear side of the switching valves 26*c*1 and 26*c*2 (in an OUT side of each of the oil hydraulic actuators 26*b*1 and 26*b*2). The front and rear differential pressure Δp of each of the switching valves 26*c*1 and 26*c*2 can be expressed by the following formula.

$$\Delta p = Pp - P\max$$

In this formula, Pmax is a maximum load pressure of the oil hydraulic actuators 26*b*1 and 26*b*2. The maximum oil pressure (the relief pressure Pf) of a whole of the oil hydraulic circuit 26 can be set by the relief valve 26*g,* and in the exemplified machine, the relation Pf=360 kg/cm$^2$ is established.

The respective switching valves 26*c*1 and 26*c*2 input exciting currents IF1 and IF2 at the left ends thereof from the control device 25 so as to be at a positive rotation position (a left position in the drawing), and enlarge the opening area Z in proportion to the magnitudes of the exciting currents IF1 and IF2. On the contrary, the respective switching valves 26*c*1 and 26*c*2 input exciting currents IR1 and IR2 at the right ends thereof from the control device 25 so as to be at an inverse rotation position (a right position in the drawing), and enlarge the opening area Z in proportion to the magnitudes of the exciting currents IR1 and IR2. When each of the valves corresponds to a proportional solenoid type 3 position switching valve which is set to a neutral position (a central position in the drawing) by a neutral spring provided at both ends of each of the switching valves 26*c*1 and 26*c*2 when inputting none of the exciting currents IF1, IF2, IR1 and IR2.

The dial 27*a,* the switch 27*b* and the dials 27*c* to 27*i* are structured such that the operator manually inputs signals, interruption signals and the like for changing various kinds of set values in the operation program to the control device 25. Hereinafter, the details thereof will be described below.

The dial 27*a* corresponds to a dial by which the operator freely sets a target crushing size of the wood 2. The target crushing size is substantially proportional to the actual crushing rotational speed Nh of the rotary crusher 1. The dial 27*a* corresponds to a target crushing rotational speed setting dial for setting the target crushing rotational speed Nhm. In this case, this also corresponds to a dial for freely setting at each of the materials.

For example, a relation Nhm=700 rpm is designated and input when crushing the useless material wood and the like after growing the mushroom so as to make them manure, a relation Nhm=600 rpm is designated and input when crushing the wood 2 and the like of the broken house, a relation Nhm=500 rpm to 600 rpm is designated and input when crushing the live wood such as a pine tree in mountains and forests, and a relation Nhm=400 rpm is designated and input when crushing the hard and thick material wood such as the crosstie in the railroad line. Further, a relation Nhm=300 rpm is designated and input when crushing the hard and strong material such as the engineering plastic. Accordingly, marks corresponding to the respective designated inputs are placed around the target crushing rotational speed setting dial 27*a*. Further, in an operation manual, there are shown a hardness, a length, a shape, a thickness, a crushed amount per a unit time and the like of a wood 2 and the like which are preferable for rotational speeds each of which are obtained by separating a range of Nhm=250 rpm to 750 rpm by 50 rpm. Accordingly, when the operator determines the target crushing size of the wood 2 and aligns the target crushing rotational speed setting dial 27*a* to the position corresponding thereto, the signal is input to the control device 25. The control device 25 sets the target crushing rotational speed Nhm and sets the exciting current IF2 corresponding thereto. Further, the control device 25 previously stores the target tub rotational speed Ntm which is preferable for each of the target crushing rotational speed Nhm in accordance with a matrix, a function and the like. Accordingly, at the same time of inputting the target crushing rotational speed Nhm, the control device 25 sets the target tub rotational speed Ntm in accordance with the matrix, the function and the like and sets the exciting current IF1 corresponding thereto. The crushed amount per a unit time is dependent upon the rotational speed Nt of the rotary tub 3 rather than the target crushing rotational speed Nhm. The control device 25 sets the target tub rotational speed Ntm within a range between about 0.5 to 3.5 rpm.

The switch 27*b* corresponds to a crushing operation switch by which the operator freely operates (turns on) or stops (turns off) the crushing operation actuator.

The dial 27*c* corresponds to a target crushing rotational speed renewing dial by which the operator freely increases and reduces the target crushing rotational speed Nhm (the exciting current IF2) set by the target crushing rotational speed setting dial 27*a* so as to renew the target crushing rotational speed Nhm in the control device 25. In this case, it is possible to initially set the target crushing rotational speed Nhm only by the target crushing rotational speed renewing dial 27*c*.

The dial 27*d* corresponds to a target tub rotational speed renewing dial by which the operator freely increases and reduces the target tub rotational speed Ntm (the exciting current IF1) set by the control device 25 via the target crushing rotational speed setting dial 27*a* so as to renew the target tub rotational speed Ntm in the control device 25. In this case, it is possible to initially set the target tub rotational speed Ntm only by the target tub rotational speed renewing dial 27*d*.

The dial 27*e* corresponds to a crushing coefficient setting dial by which the operator freely sets a coefficient of crushing k. The crushing coefficient k is set to be freely variable in a range of $0<k\leqq 1$. In this case, in the present embodiment, the level $0.5<k\leqq 0.8$ is set to a standard for use.

The dial 27*f* corresponds to a tub time setting dial by which the operator freely sets a tub time t10. The tub time t10 is set to be freely variable in a range of 20 sec≦t10≦50 sec.

The dial 27*g* corresponds to a tub inverse rotation number setting dial by which the operator freely sets a number of a tub inverse rotation n10. The tub inverse rotation number n10 is set to be freely variable in a range of 3≦n10≦5.

The dial 27*h* corresponds to a crushing time setting dial by which the operator freely sets a crushing time t20. The crushing time t20 is set to be freely variable in a range of 20 sec≦t20≦50 sec.

The dial 27*i* corresponds to a crushing inverse rotation number setting dial by which the operator freely sets a number of a crushing inverse rotation n20. The crushing inverse rotation number n20 is set to be freely variable in a range of 3≦n20≦5.

The tub rotational speed detecting device 28*a* is a so-called rotation sensor, and detects a rotational speed Nt of the output shaft of the tub oil hydraulic motor 26*b*1 so as to input to the control device 25.

The crushing rotational speed detecting device 28*b* is also a so-called rotation sensor, and detects a rotational speed Nh of the output shaft of the crusher oil hydraulic motor 26*b*2 so as to input to the control device 25.

The tub overload detecting device 29*a* is a pressure switch provided in an inlet flow passage of the tab oil hydraulic motor 26*b*1, and is closed when the negative pressure of the tub oil hydraulic motor 26*b*1 is equal to or more than 320 kg/cm$^2$ so as to input the tab overload signal P1 to the control device 25.

The crusher overload detecting device 29*b* is a pressure switch provided in an inlet flow passage of the crusher oil hydraulic motor 26*b*2, and is closed when the negative pressure of the crusher oil hydraulic motor 26*b*2 is equal to or more than 320 kg/cm$^2$ so as to input the crusher overload signal P2 to the control device 25.

The alarm 20 is constituted by an alarming device, an alarming light and an image display device, and respectively alarms, lights and displays when inputting the information signal S from the control device 25.

Next, a procedure of the crushing operation by the exemplified machine will be described below.

The operator starts the engine 26*h* so as to self-propel the exemplified machine to a working field for crushing and stop the machine.

The operator determines the target crushed size of the wood 2, and rotates the target crushing rotational speed setting dial 27*a*. The control device 25 inputs the signal and sets the target crushing rotational speed Nhm (the exciting current IF2) and the target tub rotational speed Ntm (the exciting current IF1).

When the operator turns on the crushing operation switch 27*b*, the control device 25 flows the exciting current IF1 to the tub switching valve 26*c*1 and the exciting current IF2 to the crusher switching valve 26*c*2, respectively. Accordingly, the rotary crusher 1 and the rotary tab 3 positively rotate at the respective target rotational speeds Nhm and Ntm. At this time, by throwing the wood 2 into the rotary tub 3, in accordance with the rotation thereof, the wood 2 is introduced to the cutter 1*b*, the cutter 1*b* crushes the wood 2 into a predetermined size, and the crushed pieces are discharged outward from the belt conveyor.

In this case, there is a case that the respective actual rotational speed Nh and Nt of the rotary crusher 1 and the rotary tub 3 do not become the respective target rotational speed Nhm and Ntm. That is, since each of the actual rotational speed Nh and Nt are constant without relation to a magnitude of the load of both of the oil hydraulic motors 26*b*1 and 26*b*2 due to the CLSS, it is expected that the relation Nh=Nhm and Nt=Ntm is established. However, for example, when an overload is applied to the rotary tub 3 and the load pressure thereof reaches the relief pressure Pf (for example, Pf=360 kg/cm$^2$), without relation to the stroke (or the opening area) of the switching valve 26*c*1 in the tub oil hydraulic motor 26*b*1, the rotary tub 3 stops rotation in the same manner as that of an open-center load sensing system (hereinafter, refer to as an OLSS). However, since the crusher oil hydraulic motor 26*b*2 continuously has a function of the CLSS, a crushing by the rotary crusher 1 is promoted and the rotation of the rotary tub 3 is restarted.

On the contrary, when the overload is applied to the rotary crusher 1 and the negative pressure reaches the relief pressure Pf, without relation to the stroke (or the opening area) of the switching valve 26*c*2 in the crusher oil hydraulic motor 26*b*2, this also stops rotation in the same manner as that of the OLSS. At this time, in the rotary tub 3, since the rotary crusher 1 stops, it easily reaches the relief pressure Pf by the internal wood 2 and is going to easily stop. However, before the rotary tub 3 stops rotation, the overload of the rotary crusher 1 is cancelled due to the rotation thereof.

In this case, when performing the crushing operation at a high efficiency, each of average load pressures of both of the oil hydraulic motors 26*b*1 and 26*b*2 naturally becomes a pressure near the relief pressure Pf and is changed. Particularly speaking, the rotary crusher 1 and the rotary tub 3 continuously rotate with compensating the rotation to each other and the load pressure instantaneously reaches the relief pressure Pf, however, the overload is immediately cancelled and the pressure is decreased. Accordingly, the rotation of the rotary crusher 1 and the rotary tub 3 is returned to each of the target rotational speed Nhm and Ntm, and this change is repeated. That is, the actual rotational speeds Nh and Nt of the rotary crusher 1 and the rotary tub 3 are changed. On the contrary, when the wood 2 is completely meshed with the cutter 1*b* and can not be taken out, when the wood 2 is completely held between the convex portion of the rotary tub 3 and the cutter 1*b* and can not be taken out, or when the amount of the wood 2 is significantly much, the relief valve 26*g* continuously relieves and both of the oil hydraulic motors 26*b*1 and 26*b*2 completely stop.

In this case, when the exemplified machine is the OLSS having the oil hydraulic pump at each of the oil hydraulic actuators, it is significantly hard to maintain each of the actual rotational speeds Nh and Nt to the target rotational speeds Nhm and Ntm only by adjusting the stroke of each of the switching valves 26*c*1 and 26*c*2. Then, the operator rotates the target crushing rotational speed renewing dial 27*c* and the target tub rotational speed renewing dial 27*d* as well as adjusting the amount of the wood 2 in accordance with the state of change in each of the actual rotational speed Nh and Nt (or without adjusting it). The control device 25 inputs the signal and renews the target crushing rotational speed Nhm (the exciting current IF2) and the target tub rotational speed Ntm (the exciting current IF1).

Stop of the crushing operation can be achieved by an operation that the operator turns off the crushing operation switch 27*b*.

Next, a description will be given of a particular embodiment of a control by the control device 25 which installs crusher overload judging means 25*b* and tub overload judging means 25*a*, that is, a first control embodiment for automatically changing the rotary tub 3 from the positive rotation to the inverse rotation or stopping the rotary tub 3, and a second control embodiment for automatically changing the rotary crusher 1 from the positive rotation to the inverse rotation or stopping the rotary crusher 1. These correspond to a control for reducing a chance of rotating the target crushing rotational speed renewing dial 27*c* and the target tub rotational speed renewing dial 27*d* by the operator and increasing an efficiency of crushing.

At first, a description will be given of the first control embodiment for automatically changing the rotary tub 3 from the positive rotation to the inverse rotation or stopping the rotary tub 3.

When inputting the crushing coefficient k (for example, k=0.7) from the crushing coefficient setting dial 27*e* shown in FIG. 6, the control device 25 multiplies the target crushing rotational speed Nhm by this and calculates a lower limit speed No, i.e., a crushing threshold N0 (for example, N0=0.7·Nhm). This crushing threshold N0 becomes a value for automatically rotating the rotary tub 3 in an inverse direction and stopping the rotary tub 3 as mentioned below. Further, the control device 25 inputs the tub inverse rotation number n10 (for example, n10=three times) from the tub inverse rotation number setting dial 27*g* as well as inputting the tub time t10 (for example, t10=30 sec) from the tub time setting dial 27*f*. In this case, when the condition for the tub inverse rotation is established during the tub positive rotation, it is judged whether or not the condition for the inverse rotation is again established, after inversely rotating for a certain setting time. When the condition for the inverse rotation is not again established, a positive rotation is performed, and when the condition is established, an inverse rotation is again performed. Then, when the inverse rotation is performed at a setting number within the setting time, the rotary tub 3 is stopped.

A flow of an operation of the control device 25 will be described below with reference to a flow chart for controlling the rotary tub 3 shown in FIG. 7.

In a step S10, the rotary tub 3 and the rotary crusher 1 positively rotate, and in a step S11, it is judged whether or not an inverse rotation flag ft is OFF.

In the step S11, when the inverse rotation flag ft is OFF, the step goes to a step S12 so as to compare the actual crushing rotational speed Nh from the crushing rotational speed detecting device 28 with the previously calculated crushing threshold N0.

On the contrary, in the step S11, when the inverse rotation flag ft is ON, the step goes to a step S27 and an inverse rotation is continued till the tub inverse rotation time Tt (a step S30). In this case, a relation between the tub inverse rotation number n10, the tub inverse rotation time Tt and the tub time t10 is set to Tt×n10>t10. Because a tub integrating time t1 of the first timer becomes greater than the tub time t10 during the tub inverse rotation (Tt×n10) when the relation Tt×n10≧t10 is established, so that a judgement after a step S22 can not performed.

When a result of comparison in the step S12 satisfies a relation Nh≧N0 and the tub overload signal P1 is not inputted from the tub overload detecting device 29*a* in a step S13, the tub overload judging means 25*a* positively rotates the rotary tub 3 as it is so as to crush the wood 2 (steps S14 and S17).

In the step S14, when the tub integrating time t1 of the first timer becomes the tub time t10 (=30 sec), the step goes to a step S15, and the tub overload judging means 25*a* clears the tub integrating time t1 with respect to the first timer (t1=0) and stops it. Continuously, it clears the first counter (n1=0) (a step S16), and positively rotates the rotary tub 3 as it is (a step S17).

On the contrary, when the result of comparison in the step S12 satisfies a relation Nh<N0, an inverse rotation flag ft is turned on and a tub inverse rotation timer tt is started (steps S18 to S24 and S25).

Further, when inputting the tub overload signal P1 in the step S13 unless the result of comparison in the step S12 satisfies the relation Nh<N0, it turns on the inverse rotation flag ft in the same manner and starts the tub inverse rotation timer (the steps S18 to S24 and S25).

Next, the step returns to the step S11, and the tub inverse rotation is performed for the tub inverse rotation time Tt (steps S27 and S30). In this case, the control device 25 changes the exciting current IF1 for a positive rotation to the exciting current IR1 for an inverse rotation so as to flow to the proportional solenoid type switching valve 6*c*1, whereby the tub inverse rotation can be achieved.

When the tub inverse rotation is performed at a first time in the step S18, the tub overload judging means 25*a* clears the tub integrating time t1 (t1=0), and at the same time starts the first timer so as to integrate the tub integrating time t1 (a step S19). Next, it sets the first counter one time (n1=1) (a step S20).

After performing the tub inverse rotation for the tub inverse rotation time Tt, it stops the tub inverse rotation timer so as to clear it (a step S28) and turns off the inverse rotation flag ft (a step S29). Then, when the tub overload signal P1 is not inputted in the step S13 after executing the judgement in the step S12 again, the step goes to a step S14 and the tub is positively rotated (a step S17).

On the contrary, when the tub inverse rotation is not the first time in the step S18, the step goes to a step S21. Here, when the tab integrating time t1 integrated by the first timer becomes the tab time t10 (t1=30 sec), the tub overload judging means 25*a* starts the first timer so as to integrate the tub integrating time t1 (a step S19) at the same time of clearing the tub integrating time t1 (t1=0) again, and maintains a relation n1=1 in the first counter (a step S20).

In this case, the tub overload judging means 25*a* judges whether or not a tub inverse rotation is generated while the tub integrating time t1 becomes the tub time t10 after the first tub inverse rotation (n1=1), thereby making the first counter to count.

The tub inverse rotation phenomenon is generated when the judgement Nh<N0 in the step S12 is YES after the first tub inverse rotation or when the tub overload signal P1 of the step S13 is YES. Although the judgement Nm<N0 is different from the tub overload signal P1 in view of an accuracy, it can be judged that the tub inverse rotation is generated when any one of them is YES.

When the relation t1<t10 (=30 sec) is established in the step S21 and next the relation n1<n10 is established in the step S22, the tub overload judging means 25*a* adds 1 to the tub inverse rotation number n1 at every one time of the tub inverse rotations (a step S23).

On the contrary, when the tub inverse rotation including the first tub inverse rotation number n1 (=1 time) is generated at the tub inverse rotation number n10 (=3 times) in the step S22, the tub overload judging means 25*a* stops the rotary tub 3 (a step S26). The tub stop can be achieved by turning off the exciting current IR1 for an inverse rotation. At this time, it is desirable to stop all of the crushing operation actuators.

An alarm signal S which is previously defined at the inverse rotation time and the stopping time respectively is applied to the alarm 20. In the case of the alarming device, an intermittent alarm or a high sound is generated at the inverse rotation time and a continuous alarm or a low sound is generated at the stopping time. In the case of the alarming light, a yellow light or an on-and-off light is generated at the inverse rotation time and a red light or an on light is generated at the stopping time. In the case of the image display device, a history data thereof is displayed. In this case, the tub inverse rotation time Tt is explained as the set value, however, it is possible to make them freely variable by the dial.

In accordance with the first control embodiment, the following operational effect can be obtained.

In view of the structure of the rotary tub 3 in the exemplified machine, and the relation between the structure and the rotary crusher 1, the rotary tub 3 is inversely rotated when the overload is generated, whereby the automatic cancellation of the overload of the rotary tub 3 itself and the rotary tub 3 on the basis of the rotary crusher 1 can be promoted. That is, the rotational speeds of the rotary tub 3 and the rotary crusher 1 are changed in accordance with the inverse rotation of the rotary tub 3 at a moment or at a short time such as about some minutes, however, as the accumulated operation time becomes longer, for example, ten minutes, thirty minute, an hour, a half day, a day and a month, each of the average actual rotational speeds Nt and Nh during all the period is going to converge into each of the target rotational speed Ntm and Nhm. That is, an efficiency of the crushing operation is significantly improved.

Further, when the overload is not cancelled even after many times of inverse rotations, the rotary tub 3 or all the crushing operation actuators stops. Accordingly, the rotary crusher mill 1, the rotary tub 3 and the like are not broken due to the overload. In this case, since a number of generation of the inverse rotation is a few such as three times per 30 sec, it does not cause a reduction of the crushing operation efficiency.

Further, the inverse rotation of the rotary tub 3 is controlled by not only the crushing threshold N0 but also the tub overload signal P1. Accordingly, the average actual rotational speeds Nt and Nh of the rotary tub 3 and the rotary crusher 1 during all the period are aligned with the target rotational speeds Ntm and Nhm at a high accuracy. In this case, when controlling the positive rotation, the negative rotation and the stopping of the rotary tub 3 only by the tub overload signal P1 without using the crushing threshold N0, the accuracy is lowered, however, a degree of freedom of the control is increased.

Next, a description will be given of a second control embodiment which automatically rotates the rotary crusher 1 from a positive direction to an inverse direction or stops it.

The control device 25, as shown in FIG. 6, inputs the crushing inverse rotation number n20 (for example, n20= four times) from the crushing inverse rotation number setting dial 27*i* as well as inputting the crushing time t20 (for example, t20=35 sec) from the crushing time setting dial 27*h*. Further, the control device 25 has a second timer (not shown) therewithin and integrates the crushing integrated time t2 at a time interval after the first crushing inverse rotation is generated. Still further, the control device 25 installs a second counter (not shown) therewithin, and counts the crushing inverse rotation generated during the crushing time t20 after the first crushing inverse rotation is generated.

A flow of an operation of the control device 25 will be described below with reference to a flow chart for controlling the rotary crusher shown in FIG. 8.

In a step S40, the rotary crusher 1 and the rotary tub 3 positively rotate, and in a step S41, it is judged whether or not an inverse rotation flag fh is OFF.

In the step S41, when the inverse rotation flag fh is OFF, the step goes to a step S42.

In the step S42, when not inputting the crushing overload signal P2 from the crushing overload detecting device 29*b*, the crusher overload judging means 25*b* positively rotates the rotary crusher 1 as it is so as to crush the wood 2 (steps S43 and S46).

On the contrary, in the step S41, when the inverse rotation flag fh is ON, the step goes to a step S57 and an inverse rotation is continued for the crushing inverse rotation time Th (a step S60). In this case, a relation between the crushing inverse rotation number n20, the crushing inverse rotation time Th and the crushing time t20 is set to Th×n20<t20. Because a crushing integrating time t2 of the second timer becomes greater than the crushing time t20 during the crushing inverse rotation (Th×n20) when the relation Th×n20≧t20 is established, so that a judgement after a step S51 is not performed.

In the step S43, when the crushing integrating time t2 of the second timer becomes the crushing time t20 (=35 sec), the crushing overload judging means 25*b* clears the crushing integrating time t2 with respect to the second timer (t2=0) and stops it (S44). Continuously, it clears the second counter (n2=0) (a step S45), and positively rotates the rotary crusher 1 as it is (a step S46).

On the contrary, when inputting the crushing overload signal P2 from the crushing overload detecting device 29*b* in the step S42, the crusher overload judging means 25*b* turns on an inverse rotation flag fh on and starts a crushing inverse rotation timer (steps S47 to S53 and S54). Next, the step returns to the step S41, and the crushing inverse rotation is performed for the crushing inverse rotation time Th (steps S57 to S60). In this case, the crusher overload judging means 25*b* changes the exciting current IF2 for a positive rotation to the exciting current IR2 for an inverse rotation so as to flow to the proportional solenoid type switching valve 26*c*2, whereby the crushing inverse rotation can be achieved.

When the crushing inverse rotation is performed at a first time in the step S47, the crusher overload judging means 25*b* clears the crusher integrating time t2 (t2=0), and at the same time starts the second timer so as to integrate the crushing integrating time t2 (a step S48). Next, it sets the second counter to a relation n2=1 and counts the crushing inverse rotation number n2 at the first time (a step S49).

On the contrary, when the crushing inverse rotation is not the first time in the step S47, the step goes to a step S50. Here, when the crushing integrating time t2 integrated by the second timer becomes the crushing time t20 (t1=35 sec), the crusher overload judging means 25*b* starts the second timer so as to integrate the crushing integrating time t2 (a step S48) at the same time of clearing the crushing integrating time t2 (t2=0) again. At this time, the control device 25 maintains a relation n2=1 in the second counter (a step S49).

When the crushing inverse rotation is performed for the crushing inverse rotation time Th, the crusher overload judging means 25*b* stops the crushing inverse rotation timer so as to clear (a step S58), and turns off the inverse rotation flag fh (a step S58). Then, executing the judgement in the step S41 again, and when not inputting the crushing overload signal P2 in the step S42, the step goes to the step S43 and the rotary crusher 1 is positively rotated (a step S46).

In this case, the crusher overload judging means 25*b* judges whether or not a crushing inverse rotation is generated while the crushing integrating time t2 becomes the crushing time t20 after the first crushing inverse rotation (n2=1), thereby making the second counter to count.

The crushing inverse rotation phenomenon is generated between the first crushing inverse rotation and the crushing time t20 when the crushing overload signal P2 in the step S42 is YES.

The crusher overload judging means 25*b* adds 1 to the crushing inverse rotation number n2 at every one time when the crushing inverse rotation is generated within the crushing time t20 (=35 sec) (a step S52).

When the crushing inverse rotation including the first crushing inverse rotation number n2 (=1) is generated at the crushing inverse rotation number n2 (=4 times) (n2=n20), the crusher overload judging means 25*b* stops the rotary crusher 1 (steps S51 and S55). The crushing stop can be achieved by turning off the exciting current IR2 for an inverse rotation. At this time, it is desirable to stop all of the crushing operation actuators.

At the crushing inverse rotation and the crushing stop time, a previously defined alarm signal S is applied to the alarm 20. For example, in the case of the alarming device, an intermittent alarm or a high sound is generated at the inverse rotation time and a continuous alarm or a low sound is generated at the stopping time. In the case of the alarming light, a yellow light or an on-and-off light is generated at the inverse rotation time and a red light or an on light is generated at the stopping time. In the case of the image display device, a history data thereof is displayed.

In accordance with the second control embodiment, the following operational effect can be obtained.

In view of the structure of the rotary crusher 1 in the exemplified machine, and the relation between the structure and the rotary tub 3, the rotary crusher 1 is inversely rotated when the overload is generated, whereby the automatic cancellation of the overload can be promoted. Accordingly, the same operation and effects as those of the first control embodiment can be obtained.

Here, in the second control embodiment, since the crushing threshold N0 is not employed due to a simplification, it is unavoidable that an accuracy for aligning each of the actual rotational speed Nt and Nh with each of the target rotational speed Ntm and Nhm is lowered at that degree. In the case of putting importance to the accuracy, it is desirable to employ the crushing threshold.

Hereinafter, an application of the second embodiment will be briefly described below.

(1) In the present embodiment, the overload signals P1 and P2 are constituted by the oil hydraulic pressure, however, these may be constituted by the actual rotational speeds Nt and Nh of the rotary tub 3 and the rotary crusher 1 and the torque of the output shafts in both of the oil hydraulic motors 26*b*1 and 26*b*2. In summary, any of the overload information of the rotary tub 3 and the rotary crusher 1 may be employed.

(2) In the present embodiment, the oil hydraulic circuit 26 is constituted by the CLSS, however, this may be constituted by the OLSS. In the case of the OLSS, when executing the rotational speed control of the rotary tub 3 and the rotary crusher 1 which has been considered to be hard in the same manner as that of the first or second control embodiment, it is possible to be rather preferably executed.

(3) The structures of the first control embodiment and the second control embodiment can be singly utilized respectively, however, it is possible to employ a structure obtained by suitably combining a part of them (for example, the crushing threshold N0 and the overload signals P1 and P2) in accordance with an object.

What is claimed is:

1. A self-propelled crushing machine in which a rotary crusher and a rotary tub for introducing a material to be crushed, thrown from an outer portion to the rotary crusher, are provided on a self-propelled truck, and the material to be crushed, which is introduced from the rotary tub, is crushed by the rotary crusher and freely discharged to the outer portion, said self-propelled crushing machine comprising:

target crushing rotational speed setting means for independently and selectively setting a target crushing rotational speed (Nhm) of said rotary crusher so as to obtain a desired grain size of the crushed material;

actual crushing rotational speed detecting means for detecting an actual crushing rotational speed (Nh) of the rotary crusher;

crusher drive means for setting the rotary crusher to be freely rotated; and control means for inputting a target crushing rotational speed (Nhm) from said target crushing rotational speed setting means, inputting the actual crushing rotational speed (Nh) from said actual crushing rotational speed detecting means, comparing the target speed (Nhm) with the actual speed (Nh), and outputting a crushing rotation control signal (Nhn) for maintaining a relation Nh−Nhm=0 to the crusher drive means.

2. A self-propelled crushing machine in which a rotary crusher and a rotary tub for introducing a material to be crushed, thrown from an outer portion to the rotary crusher, are provided on a self-propelled truck, and the material to be crushed, which is introduced from the rotary tub, is crushed by the rotary crusher and freely discharged to the outer portion, said self-propelled crushing machine comprising:

target crushing rotational speed setting means for setting a target crushing rotational speed (Nhm) of said rotary crusher so as to obtain a desired grain size of the crushed material;

actual crushing rotational speed detecting means for detecting an actual crushing rotational speed (Nh) of the rotary crusher;

crusher drive means for setting the rotary crusher to be freely rotated;

control means for inputting a target crushing rotational speed (Nhm) from said target crushing, rotational speed setting means, inputting the actual crushing rotational speed (Nh) from said actual crushing rotational speed detecting means, comparing the target speed (Nhm) with the actual speed (Nh), and outputting a crushing rotation control signal (Nhn) for maintaining a relation Nh−Nhm=0 to the crusher drive means;

tub drive means for making said rotary tub rotatable; and control means for inputting a target crushing rotational speed (Nhm) from said target crushing rotational speed setting means, inputting the actual crushing rotational speed (Nh) from said actual crushing rotational speed detecting means, comparing the target speed (Nhm) with the actual speed (Nh), outputting a crushing rotation control signal (Nhn) for maintaining a relation Nh−Nhm=0 to the crusher drive means and outputtinig a tub rotation control signal (Ntn) to the tub drive means.

3. A self-propelled crushing machine as claimed in claim 2, further comprising control means for freely setting a crushing rotational speed (Nh0) having a relation Nh0<Nhm which is smaller than said target crushing rotational speed (Nhm), and respectively outputting a tub rotation control signal (Nt1) for normally rotating said rotary tub, a tub rotation control signal (Nt2) for gradually reducing a positive rotational speed (Nt) in accordance with a reduction of the actual crushing rotational speed (Nh), and a tub rotation control signal (Nt3) for inversely rotating said rotary tub or stopping said rotary tub to said tub drive means (14) when said actual crushing rotational speed (Nh) satisfies a relation Nh≧Nhm, a relation Nhm>Nh>Nh0, and a relation Nh≦Nh0 so as to widely obtain crushed material having a desired grain size, and to increase a crushing efficiency.

4. A self-propelled crushing machine as claimed in claim 3, further comprising gradual reduction degree setting means for previously setting a degree f(L) of a gradual reduction of the rotational speed of said rotary tub so as to obtain a further higher crushing efficiency.

* * * * *